US008864634B2

(12) United States Patent
Mikulski

(10) Patent No.: US 8,864,634 B2
(45) Date of Patent: Oct. 21, 2014

(54) WEIGHT-LIFTING BAR

(75) Inventor: Derek Mikulski, Chesterfield, MI (US)

(73) Assignee: Innovative Xercise Solutions, LLC, Bloomfield Hills, MI (US)

( * ) Notice: Subject to any disclaimer, the term of this patent is extended or adjusted under 35 U.S.C. 154(b) by 421 days.

(21) Appl. No.: 13/116,149

(22) Filed: May 26, 2011

(65) Prior Publication Data

US 2012/0302409 A1 Nov. 29, 2012

(51) Int. Cl.

| | |
|---|---|
| ***A63B 21/06*** | (2006.01) |
| ***A63B 21/072*** | (2006.01) |
| ***A63B 21/075*** | (2006.01) |
| *A63B 71/06* | (2006.01) |

(52) U.S. Cl.

CPC ..... *A63B 21/0726* (2013.01); *A63B 21/0603* (2013.01); *A63B 21/0724* (2013.01); *A63B 21/075* (2013.01); *A63B 2071/0625* (2013.01); *A63B 2071/0652* (2013.01); *A63B 2071/0655* (2013.01)

USPC ..... 482/93; 482/106

(58) Field of Classification Search

USPC ..... 482/92–93, 44–50, 104–110, 148, 91, 482/111, 139; 73/1.73; 446/170; 273/289–291

See application file for complete search history.

(56) References Cited

U.S. PATENT DOCUMENTS

| | | | | | |
|---|---|---|---|---|---|
| 2,447,218 | A | * | 8/1948 | Trzesniewski | 482/106 |
| 3,758,109 | A | * | 9/1973 | Bender | 482/93 |
| 4,455,020 | A | * | 6/1984 | Schnell | 482/106 |
| 4,538,806 | A | * | 9/1985 | Wilkerson | 482/108 |
| 4,593,903 | A | * | 6/1986 | Waitz | 482/93 |
| 4,693,469 | A | * | 9/1987 | Cedar | 482/81 |
| 4,743,016 | A | * | 5/1988 | Van Derworp et al. | 482/93 |
| 5,063,098 | A | * | 11/1991 | Niwa et al. | 428/76 |
| 5,211,616 | A | | 5/1993 | Riley, Jr. | |
| 5,244,445 | A | * | 9/1993 | Amesquita | 482/110 |
| 5,312,314 | A | * | 5/1994 | Stephan et al. | 482/110 |
| 5,364,324 | A | * | 11/1994 | Boettiger, Jr. | 482/46 |

(Continued)

FOREIGN PATENT DOCUMENTS

| | | | |
|---|---|---|---|
| CN | 201519423 | U | 7/2010 |
| DE | 29800445 | U1 | 3/1998 |

(Continued)

OTHER PUBLICATIONS

International Search Report and Written Opinion for International application No. PCT/US2012/039465 dated Nov. 5, 2012.

(Continued)

*Primary Examiner* — Loan H Thanh
*Assistant Examiner* — Gregory Winter
(74) *Attorney, Agent, or Firm* — Buckert Patent & Trademark Law Firm P.C.; John F. Buckert

(57) ABSTRACT

A weight-lifting bar is provided. The weight-lifting bar includes a tubular member having a first end portion and a second end portion. The tubular member further includes an internal region. The weight-lifting bar further includes a plurality of balls disposed in the internal region of the tubular member that at least partially fills the internal region. The weight-lifting bar further includes a first endcap member configured to be coupled to the first end portion, and a second endcap member configured to be coupled to the second end portion.

15 Claims, 8 Drawing Sheets

(56) References Cited

U.S. PATENT DOCUMENTS

| | | | | |
|---|---|---|---|---|
| 5,364,325 | A | 11/1994 | Matthews | |
| 5,803,126 | A * | 9/1998 | Zaro | 138/89 |
| 5,876,312 | A * | 3/1999 | McClendon | 482/93 |
| 6,682,464 | B2 * | 1/2004 | Shifferaw | 482/106 |
| 6,981,933 | B2 * | 1/2006 | Scafidel | 482/110 |
| 7,112,164 | B1 | 9/2006 | Hoagland | |
| 7,998,031 | B2 * | 8/2011 | Dumke et al. | 482/55 |
| 8,128,541 | B2 * | 3/2012 | Hartman | 482/139 |
| 2003/0167804 | A1 * | 9/2003 | Yoon | 68/232 |
| 2004/0063554 | A1 | 4/2004 | Wince | |
| 2006/0105891 | A1 | 5/2006 | Cappellini et al. | |
| 2008/0081742 | A1 * | 4/2008 | Dumke et al. | 482/55 |
| 2008/0200315 | A1 * | 8/2008 | Lin | 482/106 |
| 2009/0197742 | A1 * | 8/2009 | Hartman | 482/50 |
| 2010/0227747 | A1 | 9/2010 | Cook | |

FOREIGN PATENT DOCUMENTS

| | | | |
|---|---|---|---|
| DE | 202009017604 | U1 | 5/2010 |
| JP | H0239763 | U | 3/1990 |
| JP | 2001145706 | A | 5/2001 |
| JP | 2002191717 | A | 7/2002 |
| WO | 02051505 | A | 7/2002 |

OTHER PUBLICATIONS

International Preliminary Report on Patentability for International application No. PCT/US2012/039465 dated Nov. 26, 2013.

* cited by examiner

WEIGHT-LIFTING BAR

BACKGROUND

A known weight-lifting device having weights fixedly coupled to the device has been utilized. A problem associated with the known weight-lifting device is that a user may use an improper lifting technique when lifting the device and not be aware of the improper lifting technique. The inventor herein has recognized that the known weight-lifting device is also not specifically designed to improve a users balance and neuromuscular coordination.

The inventor herein has recognized a need for a weight-lifting bar and methods that reduce and/or eliminate the above-mentioned deficiencies.

SUMMARY

A weight-lifting bar in accordance with an exemplary embodiment is provided. The weight-lifting bar includes a tubular member having a first end portion and a second end portion. The tubular member further includes an internal region. The weight-lifting bar further includes a plurality of balls disposed in the internal region of the tubular member that at least partially fills the internal region. The weight-lifting bar further includes a first endcap member configured to be coupled to the first end portion, and a second endcap member configured to be coupled to the second end portion.

A method of weight-training in accordance with another exemplary embodiment is provided. The method includes grasping a weight-lifting bar with at least one hand. The weight-lifting bar having a tubular member with a plurality of balls disposed in an internal region of the tubular member. The tubular member has a longitudinally extending central axis. The method further includes raising the weight-lifting bar from a first position of a second position utilizing the at least one hand. When the longitudinally extending central axis is disposed generally perpendicular to a gravity vector, the plurality of balls are disposed in a central portion of the tubular member. When the longitudinally extending central axis is not disposed generally perpendicular to the gravity vector, the plurality of balls are disposed proximate to either a first end portion or a second end portion of the tubular member.

A method of manufacturing a weight-lifting bar in accordance with another exemplary embodiment is provided. The method includes coupling a first endcap member to a first end portion of a tubular member. The method further includes disposing a plurality of balls into an internal region of the tubular member that at least partially fills the internal region. The method further includes coupling a second endcap member to a second end portion of the tubular member.

A weight-lifting bar in accordance with another exemplary embodiment is provided. The weight-lifting bar includes a first tubular member having a first internal region. The weight-lifting bar further includes a second tubular member having a first end portion and a second end portion. The second tubular member further includes a second internal region. The second tubular member is disposed in the first internal region. The weight-lifting bar further includes a plurality of balls disposed in the second internal region of the second tubular member that at least partially fills the second internal region. The weight-lifting bar further includes a first endcap member configured to cover an opening in the first end portion. The weight-lifting bar further includes a second endcap member configured to cover an opening in the second endcap member.

DETAILED DESCRIPTION

Figure 1:
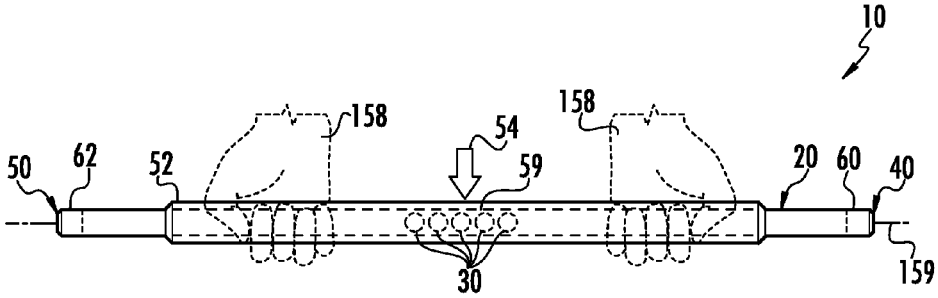
FIG. 1 is a schematic of a weight-lifting bar in accordance with an exemplary embodiment.
Figure 2:
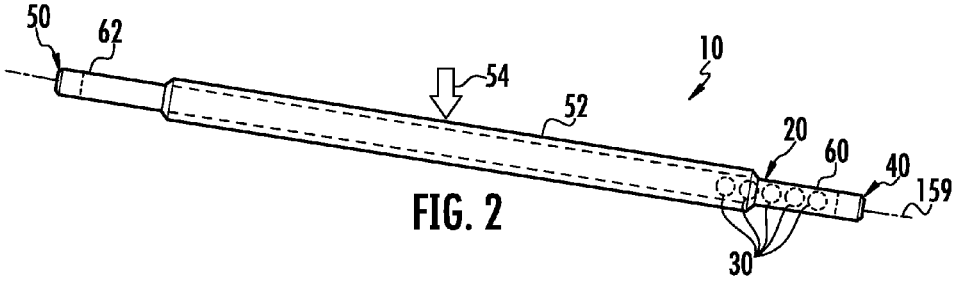
FIG. 2 is another schematic of the weight-lifting bar of FIG. 1.
Figure 3:
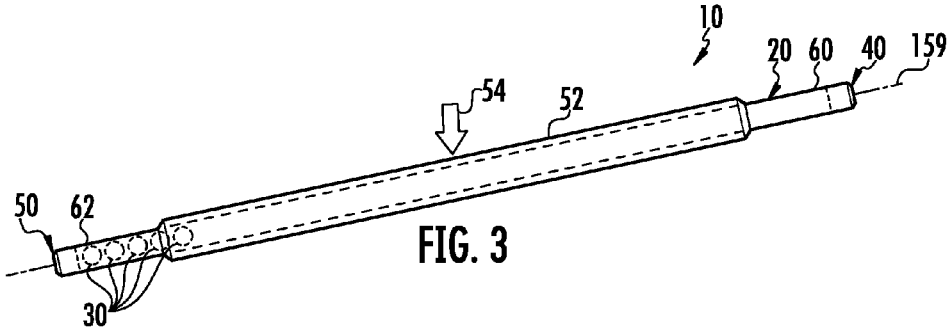
FIG. 3 is another schematic of the weight-lifting bar of FIG. 1.
Figure 4:
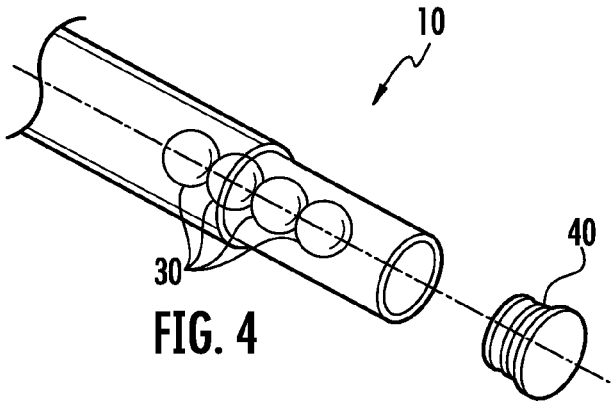
FIG. 4 is another schematic of a portion of the weight-lifting bar of FIG. 1.

Referring to FIGS. 1-3, a weight-lifting bar 10 in accordance with an exemplary embodiment is provided. The weight-lifting bar 10 includes a tubular member 20, a plurality of balls 30, a first endcap member 40, a second endcap member 50, and a foam layer 52. In one exemplary embodiment, a weight of the weight-lifting bar 10 is in a range of 2-25 pounds. Of course, in an alternative embodiment, a weight of the weight-lifting bar 10 could be greater than 25 pounds.

An advantage of the weight-lifting bar 10 is that the bar 10 has the plurality of balls 30 disposed therein which provides feedback to a user regarding whether the user is utilizing a proper technique when lifting the bar 10. In particular, when a user is lifting a weight-lifting bar, it is desirable that the weight-lifting bar be maintained substantially perpendicular to a gravity vector 54 (e.g., the bar 10 being substantially parallel to the ground). Another advantage of the weight-lifting bar 10 is that a user trying to maintain the bar 10 substantially perpendicular to the gravity vector 54 utilizes more core stability muscle fibers that improves balance and neuromuscular coordination, as compared to other weight-lifting bars.

When a user is lifting the bar 10 and is using a proper lifting technique, a longitudinally extending central axis 159 of the bar 10 is disposed generally perpendicular to the gravity vector 54, and the plurality of balls 30 are disposed in the central portion 59 of the bar 10 and thus the bar 10 feels balanced to the user. Alternately, when a user is lifting the bar 10 and is not using a proper lifting technique, the longitudinally extending central axis 159 of the bar 10 is not disposed generally perpendicular to the gravity vector 54, and the plurality of balls 30 are disposed proximate to a first end portion 60 or a second end portion 62 of the bar 10 and thus the bar 10 feels unbalanced to the user. Accordingly, when the user notices that the bar 10 is unbalanced, the user may compensate by adjusting a position of the bar 10 such that the longitudinally extending central axis 159 of the bar 10 is disposed generally perpendicular to the gravity vector 54 (e.g., the bar 10 being substantially horizontal to the ground).

Figure 5:
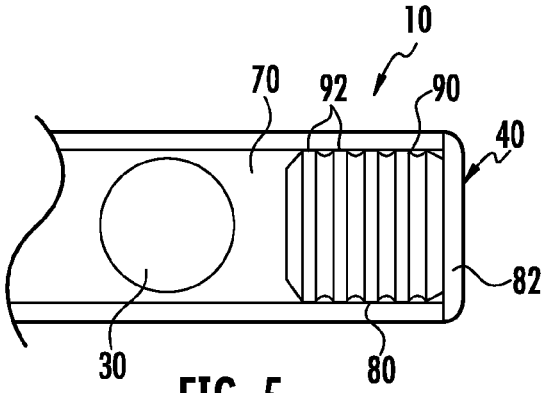
FIG. 5 is a cross-sectional schematic of a portion of another weight-lifting bar in accordance with another exemplary embodiment.
Figure 6:
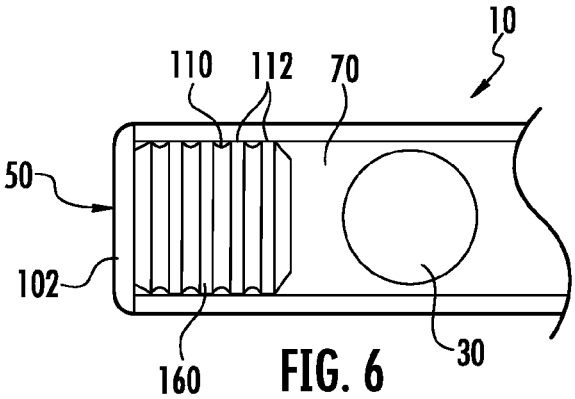
FIG. 6 is a cross-sectional schematic of another portion of the weight-lifting bar of FIG. 5.
Figure 7:
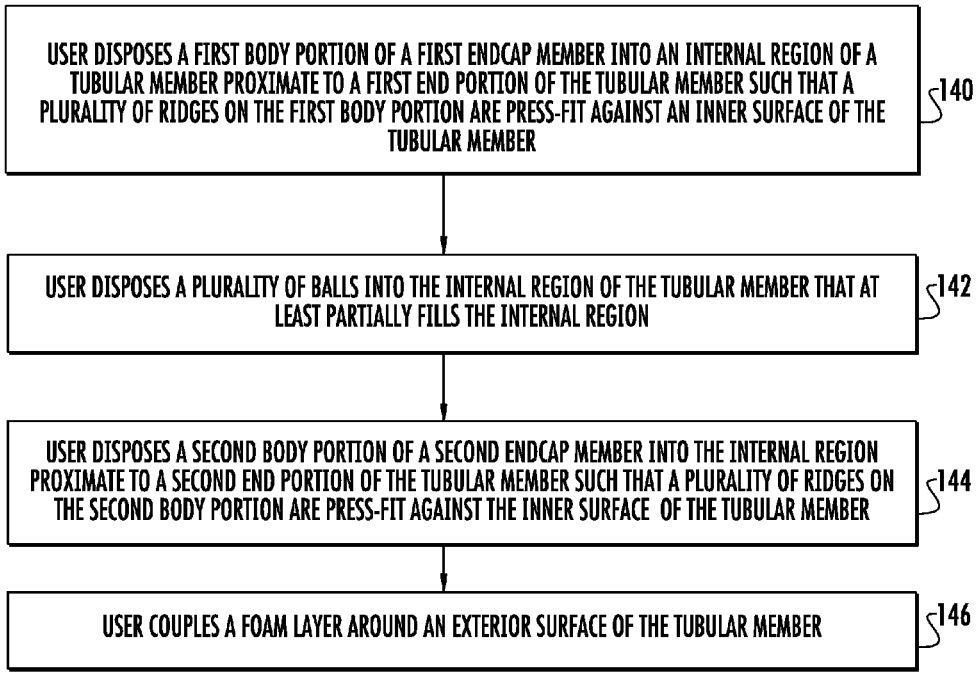
FIG. 7 is a flowchart of a method of manufacturing the weight-lifting bar of FIG. 1 in accordance with another exemplary embodiment.
Figure 8:
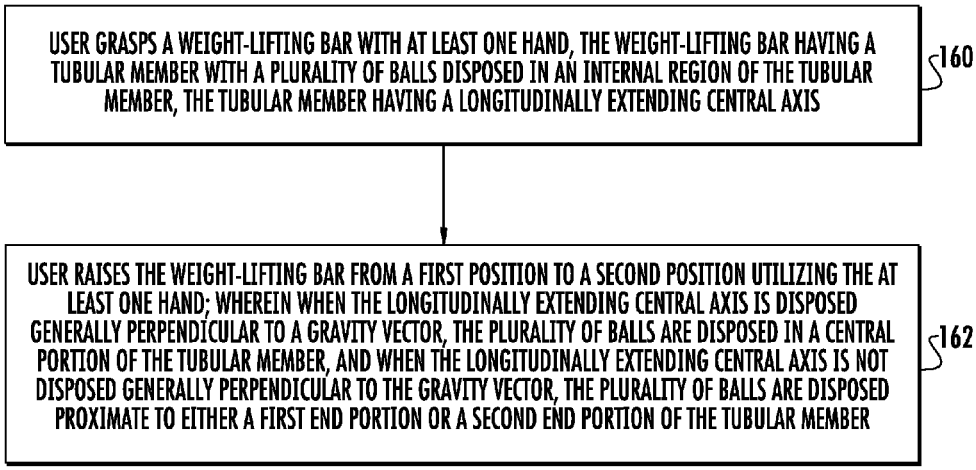
FIG. 8 is a flowchart of a method of weight-training in accordance with another exemplary embodiment.

Referring to FIGS. 1, 5 and 6, the tubular member 20 has a central portion 61, a first end portion 60, and a second end portion 62. The tubular member 20 further includes an internal region or space 70 defined therein. In one exemplary embodiment, the tubular member 20 is constructed of plastic. In an alternative embodiment, the tubular member 20 is constructed of a metal or a metal-alloy. In one exemplary embodiment, a length of the tubular member 20 is 48 inches. Of course in alternative embodiments, a length of the tubular member 20 could be greater than 48 inches or less than 48 inches. Also, in an exemplary embodiment, an outer diameter of the tubular member 20 is 0.75 inches. However, an outer diameter of the tubular member 20 could be greater than 0.25 inches or less than 2 inches for example.

The plurality of balls 30 are disposed in the internal region 70 of the tubular member 20 and at least partially fill the internal region 70. In one exemplary embodiment, each of the plurality of balls 30 is a low carbon steel ball. Of course, in an alternative embodiment, the plurality of balls 30 could be constructed of another material known to those skilled in the art such as lead for example. The diameter of each of the plurality of balls 30 is less than an inner diameter of the tubular member 20 such each of the plurality of balls 30 can move longitudinally within the internal region 70 of the tubular member 20. It should be noted that a diameter of each of the plurality of balls 30 and a number of the balls 30 can be vary depending upon a desired weight of the weight-lifting bar 10. Also, a shape of each of the balls 30 can be either spherical or any other geometric shape known to those skilled in the art that would allow the balls to move within the internal region 70. Also, in an alternative embodiment, each of the plurality of balls 30 could be coated with a plastic layer or a rubber compound layer.

Referring to FIG. 5, the first endcap member 40 is configured to be removably coupled to the first end portion 60. The first endcap member 40 has a body portion 80 and a cap portion 82 coupled to the body portion 80. The body portion 80 has an external surface 90 defining a plurality of ridges 92. The body portion 80 is configured to be received in the internal region 70 at the first end portion 60. The cap portion 82 is disposed adjacent to an end of the first end portion 60 when the body portion 80 is disposed in the internal region 70. In one exemplary embodiment, the first endcap member 40 is constructed of plastic and a maximum diameter of the body portion 80 is greater than a diameter of the internal region 70 prior to the body portion 80 being disposed in the internal region 70 such that the body portion 80 can be press-fit into the first end portion 60. In alternative embodiments, the first endcap member 40 could be constructed of other pliable materials other than plastic, such as a rubber compound, for example. The first endcap member 40 can be decoupled from the tubular member 20 by applying a longitudinally extending force to the cap portion 82 outwardly from the tubular member 20.

Referring to FIG. 6, the second endcap member 50 is configured to be removably coupled to the second end portion 62. The second endcap member 50 has a body portion 100 and a cap portion 102 coupled to the body portion 100. The body portion 100 has an external surface 110 defining a plurality of ridges 112. The body portion 100 is configured to be received in the internal region 70 at the second end portion 62. The cap portion 102 is disposed adjacent to an end of the second end portion 62 when the body portion 100 is disposed in the internal region 70. In one exemplary embodiment, the second endcap member 50 is constructed of plastic and a maximum diameter of the body portion 100 is greater than a diameter of the internal region 70 prior to the body portion 100 being disposed in the internal region 70 such that the body portion 100 can be press-fit into the second end portion 62. In alternative embodiments, the second endcap member 50 could be constructed of other pliable materials other than plastic, such as a rubber compound for example. The second endcap member 50 can be decoupled from the tubular member 20 by applying a longitudinally extending force to the cap portion 102 outwardly from the tubular member 20.

The foam layer 52 is coupled to an exterior surface of the tubular member 20 utilizing a glue or an adhesive. In an exemplary embodiment, the foam layer 52 is a polyurethane foam layer. Of course, in an alternative embodiment, the foam layer 52 could be constructed from other materials known to those skilled in the art. Also, in an alternative embodiment, the foam layer 52 is press-fit on the exterior surface of the tubular member 20.

Referring to FIGS. 1 and 4-7, a flowchart of a method for manufacturing the weight-lifting bar 10 in accordance with another exemplary embodiment will be explained.

At step 140, a user disposes the body portion 80 of the first endcap member 40 into the internal region 70 of the tubular member 20 proximate to the first end portion 60 of the tubular member 20 such that the plurality of ridges 92 on the body portion 80 are press-fit against an inner surface of the tubular member 20.

At step 142, the user disposes of the plurality of balls 30 into the internal region 70 of the tubular member 20 that at least partially fills the internal region 70. In particular, the user can dispose the plurality of balls 30 into an opening defined by a second end portion 62 of the tubular member 20 to at least partially fill the interior region 70.

At step 144, the user disposes the body portion 100 of the second endcap member 50 into the internal region 70 proximate to the second end portion 62 of the tubular member 20 such that the plurality of ridges 112 on the body portion 100 are press-fit against the inner surface of the tubular member 20.

At step 146, the user couples the foam layer 52 around an exterior surface of the tubular member 20.

Referring to FIGS. 1, 5, 6 and 8, a flowchart of a method of weight-lifting utilizing the weight-lifting bar 10 in accordance with another exemplary embodiment will now be explained.

At step 160, a user grasps the weight-lifting bar 10 with at least one hand 158. The weight-lifting bar 10 has the tubular member 20 with the plurality of balls 30 disposed in the internal region 70 of the tubular member 20. The tubular member 20 has a longitudinally extending central axis 159.

At step 162, the user raises the weight-lifting bar 10 from a first position to a second position utilizing the at least one hand 158. When the longitudinally extending central axis 159 is disposed generally perpendicular to the gravity vector 54, the plurality of balls 30 are disposed in the central portion 59 of the tubular member 20. When the longitudinally extending central axis 159 is not disposed generally perpendicular to the gravity vector 54, the plurality of balls 30 are disposed proximate to either the first end portion 60 or the second end portion 62 of the tubular member 20. If the user determines that the plurality of balls 30 are disposed proximate to either the first and portion 60 or the second end portion 62 due to a tilting of the tubular member 20, the user can compensate by moving the weight-lifting bar 20 such that the longitudinally extending central axis 159 is disposed generally perpendicular to the gravity vector 54 which will induce the plurality of balls 30 to move toward the central portion 59.

Figure 9:
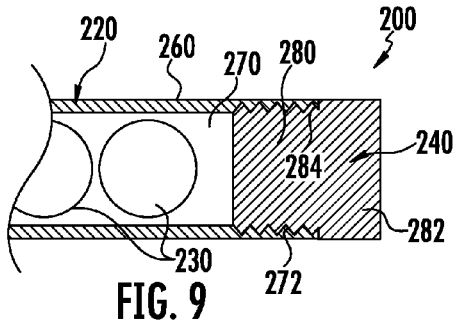
FIG. 9 is a cross-sectional schematic of a portion of another weight-lifting bar in accordance with another exemplary embodiment.
Figure 10:
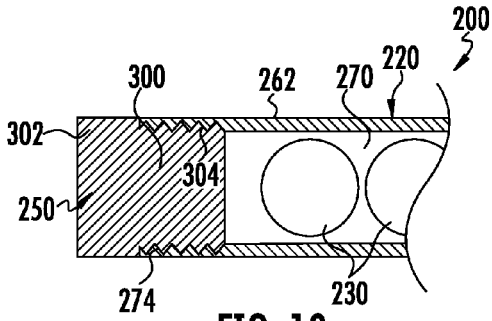
FIG. 10 is a cross-sectional schematic of another portion of the weight-lifting bar of FIG. 9.

Referring to FIGS. 9 and 10, cross-sectional schematics of portions of a weight-lifting bar 200 in accordance with another exemplary embodiment is provided. The weight-lifting bar 200 has a similar structure as the weight-lifting bar 10 except that the weight-lifting bar 200 utilizes first and second endcap members 240, 250 having a different structure than the endcap members 40, 50. Also, weight-lifting bar 200 has the tubular member 220 with internal threads utilized to couple the tubular member 20 to the first and second endcap members 240, 250. The weight-lifting bar 200 includes a tubular member 220, a plurality of balls 230, the first endcap member 240, the second endcap member 250, and a foam layer (not shown) disposed around an external surface of the tubular member 220.

The tubular member 220 has a first end portion 260 and a second end portion 262 and a central portion (not shown) disposed between the portions 260, 262. The tubular member 220 further includes an internal region or space 270 defined therein. The first end portion 260 defines internal threads 272 communicating with the internal region 270, and the second end portion 262 defines internal threads 274 communicating with the internal region 270. In one exemplary embodiment, the tubular member 220 is constructed of plastic. In an alternative embodiment, the tubular member 220 is constructed of a metal or a metal-alloy. In one exemplary embodiment, a length of the tubular member 220 is 48 inches. Of course in alternative embodiments, a length of the tubular member 220 could be greater than 48 inches or less than 48 inches. Also, in an exemplary embodiment, an outer diameter of the tubular member 220 is 0.75 inches. However, an outer diameter of the tubular member 220 could be greater than 0.25 inches or less than 2 inches for example. A foam layer (not shown) is coupled to an exterior surface of the tubular member 220, and has a substantially similar structure as the foam layer 52.

The plurality of balls 230 are disposed in the internal region 270 of the tubular member 220 and at least partially fill the internal region 270. The plurality of balls 230 have a substantially similar structure as the plurality of balls 30 and can have alternative sizes, quantifies, and shapes as discussed above with respect to the balls 30.

The first endcap member 240 is configured to be removably coupled to the first end portion 260. The first endcap member 240 has a body portion 280 and a cap portion 282 coupled to the body portion 280. The body portion 280 has threads 284 configured to be coupled to the internal threads 272 of the first end portion 260. The cap portion 282 is disposed adjacent to an end of the first end portion 260 when the body portion 280 is threadably coupled to the first end portion 260. In one exemplary embodiment, the first endcap member 240 is constructed of plastic. In alternative embodiments, the first endcap member 240 could be constructed of materials other than plastic, such as a metal or a metal-alloy for example.

The second endcap member 250 is configured to be removably coupled to the second end portion 262. The second endcap member 250 has a body portion 300 and a cap portion 302 coupled to the body portion 300. The body portion 300 has threads 304 configured to be coupled to the internal threads 274 of the second end portion 262. The cap portion 302 is disposed adjacent to an end of the second end portion 262 when the body portion 300 is threadably coupled to the second end portion 262. In one exemplary embodiment, the second endcap member 250 is constructed of plastic. In alternative embodiments, the second endcap member 250 could be constructed of materials other than plastic, such as a metal or a metal-alloy for example.

Figure 11:
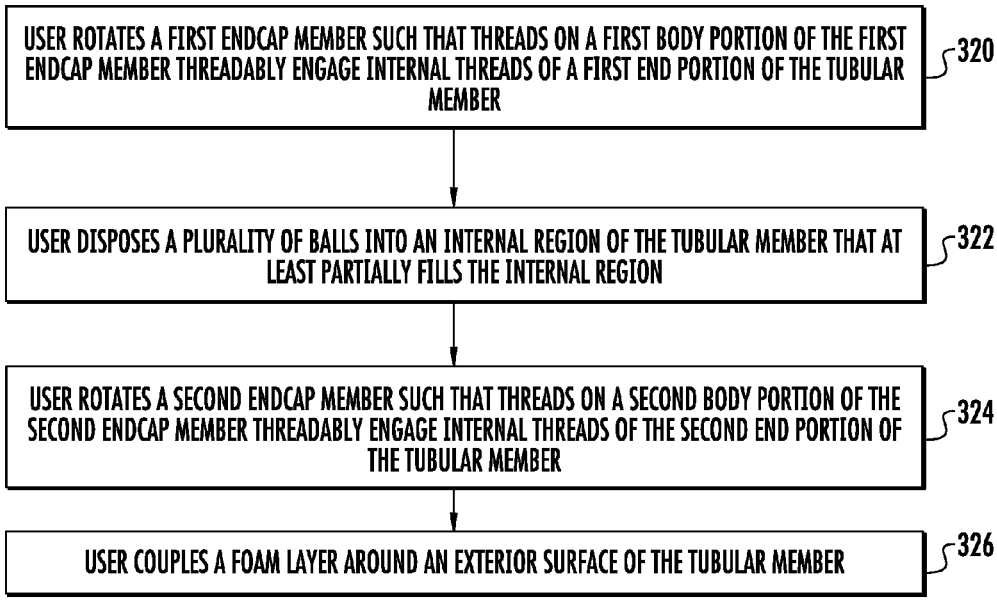
FIG. 11 is a flowchart of a method of manufacturing the weight-lifting bar of FIG. 9 in accordance with another exemplary embodiment.

Referring to FIGS. 9-11, a flowchart of a method of manufacturing the weight-lifting bar 200 in accordance with another exemplary embodiment will now be explained.

At step 320, a user rotates the first endcap member 240 such that threads 284 on the body portion 280 of the first endcap member 240 threadably engage internal threads 272 of the first end portion 260 of the tubular member 220.

At step 322, the user disposes the plurality of balls 230 into the internal region 270 of the tubular member 220 that at least partially fills the internal region 270.

At step 324, the user rotates the second endcap member 250 such that threads 304 on the body portion 300 of the second endcap member 250 threadably engage internal threads 274 of the second end portion 262 of the tubular member 220.

At step 236, the user couples a foam layer around an exterior surface of the tubular member 220.

Figure 12:
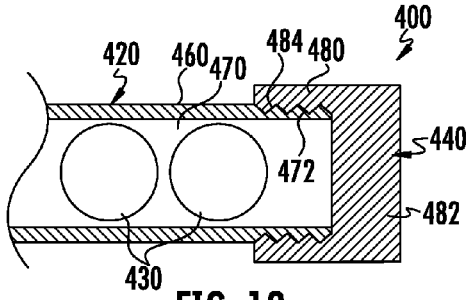
FIG. 12 is a cross-sectional schematic of a portion of another weight-lifting bar in accordance with another exemplary embodiment.
Figure 13:
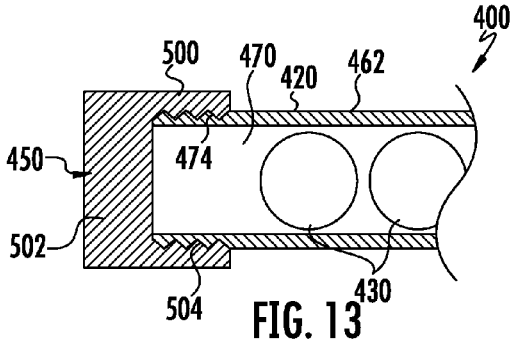
FIG. 13 is a cross-sectional schematic of another portion of the weight-lifting bar of FIG. 12.

Referring to FIGS. 12 and 13, cross-sectional schematics of portions of a weight-lifting bar 400 in accordance with another exemplary embodiment is provided. The weight-lifting bar 400 has a similar structure as the weight-lifting bar 10 except that the weight-lifting bar 400 utilizes first and second endcap members 440, 450 having a different structure than the endcap members 40, 50. Also, weight-lifting bar 400 has the tubular member 420 with external threads utilized to couple the tubular member 420 to the first and second endcap members 440, 450. The weight-lifting bar 400 includes a tubular member 420, a plurality of balls 430, the first endcap member 440, the second endcap member 450, and a foam layer (not shown) disposed around an external surface of the tubular member 420.

The tubular member 420 has a first end portion 460 and a second end portion 462 and a central portion (not shown)

disposed between the portions 460, 462. The tubular member 420 further includes an internal region or space 470 defined therein. The first end portion 460 defines external threads 472, and the second end portion 462 defines external threads 474. In one exemplary embodiment, the tubular member 420 is constructed of plastic. In an alternative embodiment, the tubular member 420 is constructed of a metal or a metal-alloy. In one exemplary embodiment, a length of the tubular member 420 is 48 inches. Of course in alternative embodiments, a length of the tubular member 420 could be greater than 48 inches or less than 48 inches. Also, in one exemplary embodiment, a diameter of the tubular member 420 is 0.75 inches. However, an outer diameter of the tubular member 420 could be greater than 0.25 inches or less than 2 inches for example. A foam layer (not shown) is coupled to an exterior surface of the tubular member 420, and has a substantially similar structure as the foam layer 52.

The plurality of balls 430 are disposed in the internal region 470 of the tubular member 420 and at least partially fill the internal region 470. The plurality of balls 430 have a substantially similar structure as the plurality of balls 30 and can have alternative sizes, quantities, and shapes as discussed above with respect to the balls 30.

The first endcap member 440 is configured to be removably coupled to the first end portion 460. The first endcap member 440 has a tubular body portion 480 and a cap portion 482 coupled to the body portion 480. The tubular body portion 480 has internal threads 484 configured to be coupled to the external threads 472 of the first end portion 460. The cap portion 482 is disposed adjacent to an end of the first end portion 460 when the body portion 480 is threadably coupled to the first end portion 460. In one exemplary embodiment, the first endcap member 440 is constructed of plastic. In alternative embodiments, the first endcap member 440 could be constructed of materials other than plastic, such as a metal or a metal-alloy for example.

The second endcap member 450 is configured to be removably coupled to the second end portion 462. The second endcap member 450 has a tubular body portion 500 and a cap portion 502 coupled to the body portion 500. The tubular body portion 500 has internal threads 504 configured to be coupled to the external threads 474 of the second end portion 462. The cap portion 502 is disposed adjacent to an end of the second end portion 462 when the tubular body portion 500 is threadably coupled to the second end portion 462. In one exemplary embodiment, the second endcap member 450 is constructed of plastic. In alternative embodiments, the second endcap member 450 could be constructed of materials other than plastic, such as a metal or a metal-alloy for example.

Figure 14:
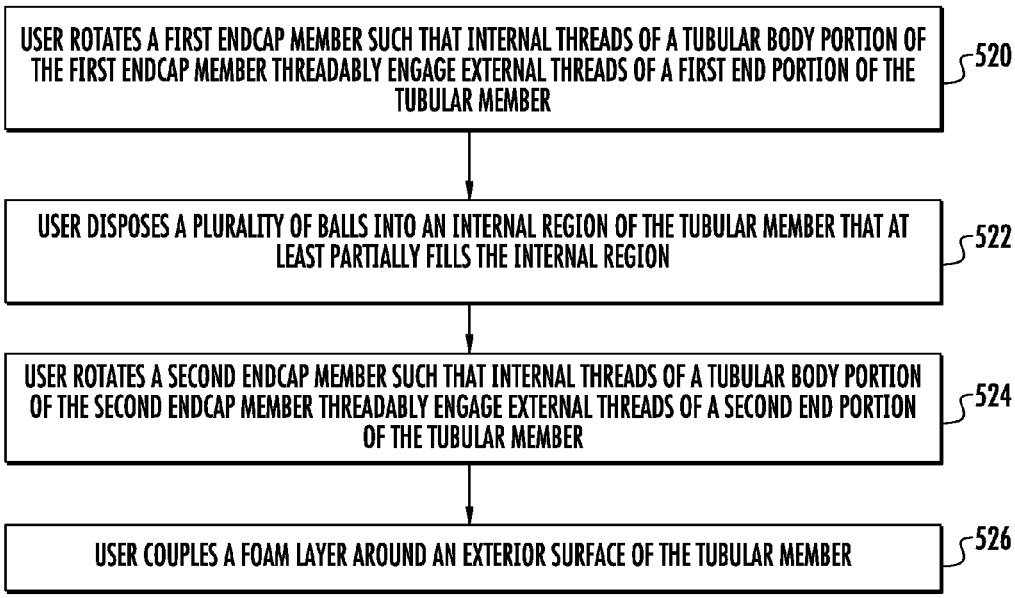
FIG. 14 is a flowchart of a method of manufacturing the weight-lifting bar of FIG. 12 in accordance with another exemplary embodiment.

Referring to FIGS. 12-14, a flowchart of a method of manufacturing the weight-lifting bar 400 in accordance with another exemplary embodiment will now be explained.

At step 520, a user rotates the first endcap member 440 such that internal threads 484 of the tubular body portion 480 of the first endcap member 440 threadably engage external threads 472 of the first end portion 460 of the tubular member 420.

At step 522, the user disposes the plurality of balls 430 into the internal region 470 of the tubular member 420 that at least partially fills the internal region 420.

At step 524, the user rotates the second endcap member 450 such that internal threads 504 of the tubular body portion 500 of the second endcap member 450 threadably engage external threads 474 of the second end portion 462 of the tubular member 420.

At step 526, the user couples a foam layer around an exterior surface of the tubular member 420.

Figure 15:
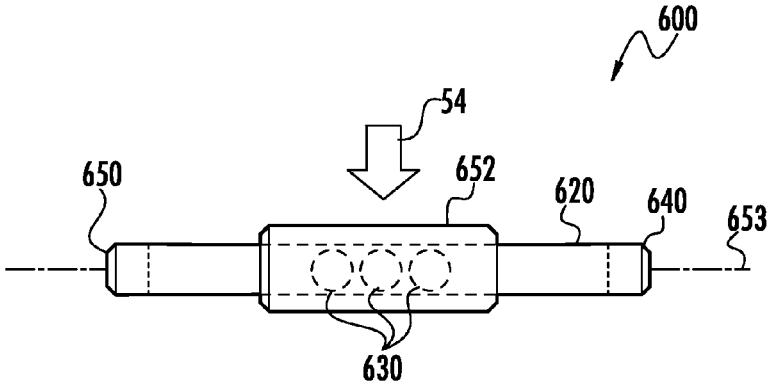
FIG. 15 is a schematic of another weight-lifting bar in accordance with an exemplary embodiment.
Figure 16:
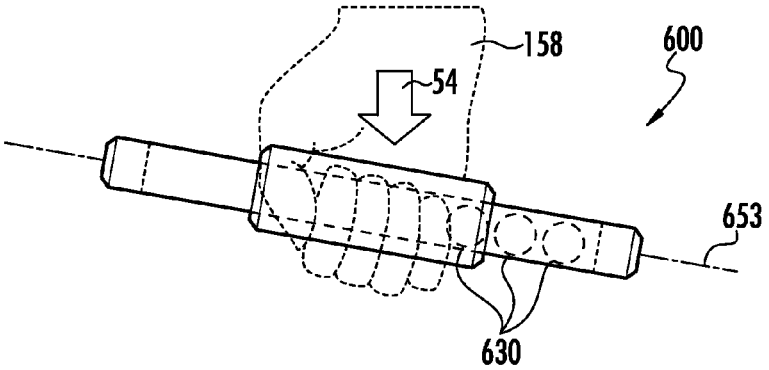
FIG. 16 is another schematic of the weight-lifting bar of FIG. 15.
Figure 17:
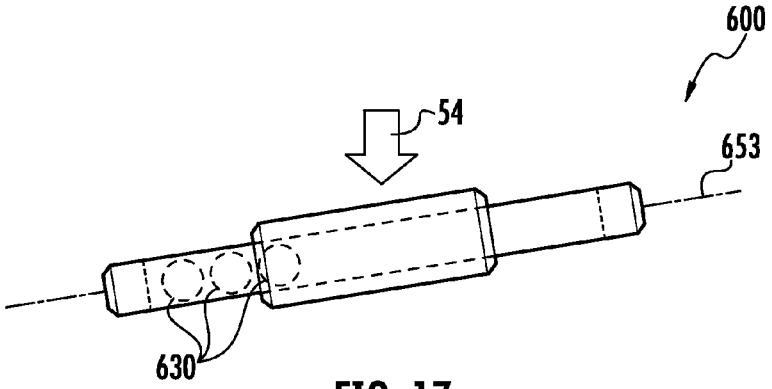
FIG. 17 is another schematic of the weight-lifting bar of FIG. 15.

Referring to FIGS. 15-16, a weight-lifting bar 600 in accordance with another exemplary embodiment is provided. The weight-lifting bar 600 includes a tubular member 620, a plurality of balls 630, a first endcap member 640, a second endcap member 650, and a foam layer 652. The weight-lifting bar 600 also has a longitudinally extending central axis 653. The structure of the components of the weight-lifting bar 600 are similar to the structure of the components of the weight-lifting bar 10 except that a longitudinal length of the weight-lifting bar 600 is less than a length of the weight-lifting bar 10. Also, the weight-lifting bar 600 can be grasped with one hand of user instead of two hands of the user. In one exemplary embodiment, a weight of the weight-lifting bar 600 is in a range of 1-15 pounds. Of course, in an alternative embodiment, the weight-lifting bar 600 could have a weight greater than 15 pounds. Also, in an exemplary embodiment, the length of the tubular member 620 is 10 inches. Of course, in alternative embodiments, the length of the tubular member 620 could be less than 10 inches or greater than 10 inches.

Also, referring to FIGS. 9, 10 and 15, in an alternative embodiment the first and second end portions of the tubular member 620 can have a similar structure as the first and second end portions 260, 262, respectively; and the first and second endcap members 640, 650 can have a similar structure as the first and second endcap members 240, 250, respectively.

Further, referring to FIGS. 12, 13 and 15, in an alternative embodiment the first and second end portions of the tubular member 620 can have a similar structure as the first and second end portions 460, 462, respectively; and the first and second endcap members 640, 650 can have a similar structure as the first and second endcap members 440, 450, respectively.

Figure 18:
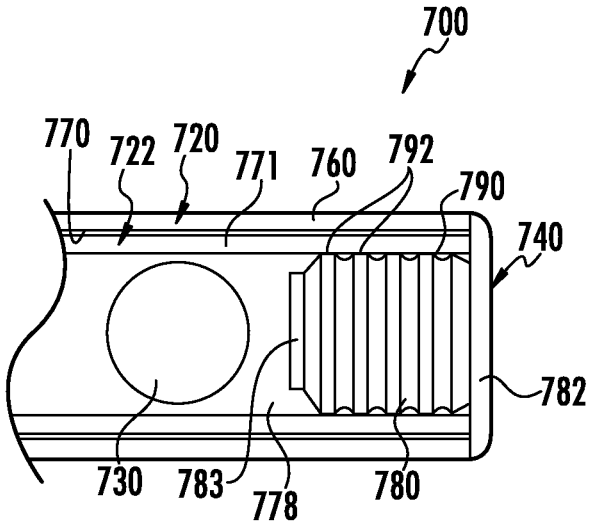
FIG. 18 is a cross-sectional schematic of a portion of another weight-lifting bar in accordance with another exemplary embodiment.
Figure 19:
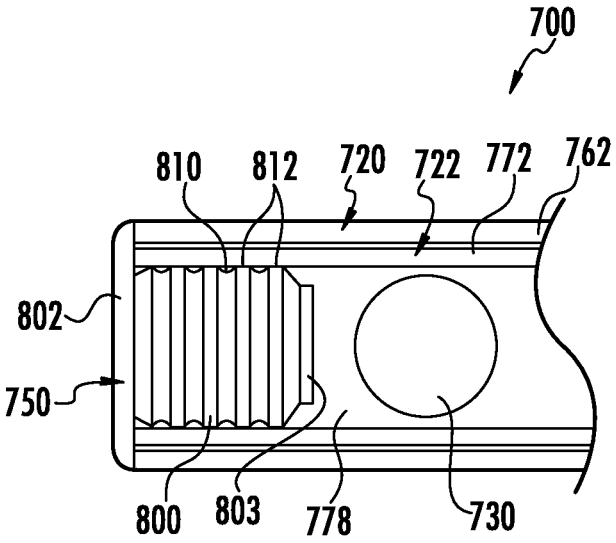
FIG. 19 is a cross-sectional schematic of another portion of the weight-lifting bar of FIG. 18.

Referring to FIGS. 18-19, a weight-lifting bar 700 in accordance with an exemplary embodiment is provided. The weight-lifting bar 700 includes a first tubular member 720, a second tubular member 722, a plurality of balls 730, a first endcap member 740, a second endcap member 750, and a foam layer (not shown). In one exemplary embodiment, a weight of the weight-lifting bar 700 is in a range of 2-25 pounds. Of course, in an alternative embodiment, a weight of the weight-lifting bar 700 could be greater than 25 pounds.

The first tubular member 720 has a first end portion 760 and a second end portion 762 with a central portion (not shown) disposed therebetween. The first tubular member 720 further includes an internal region or space 770 defined therein. In one exemplary embodiment, the first tubular member 720 is constructed of a metal or a metal-alloy. In an alternative embodiment, the first tubular member 720 is constructed of a plastic. In one exemplary embodiment, a length of the first tubular member 720 is 48 inches. Of course in alternative embodiments, a length of the first tubular member 720 could be greater than 48 inches or less than 48 inches. Also, in an exemplary embodiment, an outer diameter of the first tubular member 720 is 0.75 inches. However, an outer diameter of the first tubular member 720 could be greater than 0.25 inches or less than 2 inches for example. A foam layer (not shown) is coupled to an exterior surface of the first tubular member 720, and has a substantially similar structure as the foam layer 52.

The second tubular member 722 has a first end portion 771 and a second end portion 772 with a central portion (not shown) disposed therebetween. The second tubular member 722 further includes an internal region or space 778 defined therein. The second tubular member 722 is disposed within the internal region 770 of the first tubular member 720. In one exemplary embodiment, the second tubular member 722 is constructed of a plastic. In an alternative embodiment, the second tubular member 722 is constructed of an elastomeric material. In one exemplary embodiment, a length of the second tubular member 722 is 48 inches. Of course in alternative embodiments, a length of the second tubular member 722 could be greater than 48 inches or less than 48 inches. Also, in an exemplary embodiment, an outer diameter of the second tubular member 722 is 0.75 inches. However, an outer diameter of the second tubular member 722 could be greater than 0.25 inches or less than 2 inches for example. In an alternative embodiment, a sound reducing layer (not shown) may be disposed between the first and second tubular members 720, 722 to reduce an amount of sound emitted from the weight-lifting bar 700 by the plurality of balls 730 moving therein.

The plurality of balls 730 are disposed in the internal region 778 of the second tubular member 722 and at least partially fill the internal region 778. In one exemplary embodiment, each of the plurality of balls 730 is a low carbon steel ball. Of course, in an alternative embodiment, the plurality of balls 730 could be constructed of another material known to those skilled in the art such as lead for example. The diameter of each of the plurality of balls 730 is less than an inner diameter of the second tubular member 722 such each of the plurality of balls 730 can move longitudinally within the internal region 778 of the second tubular member 722. It should be noted that a diameter of each of the plurality of balls 730 and a number of the balls 730 can be vary depending upon a desired weight of the weight-lifting bar 700. Also, a shape of each of the balls 730 can be either spherical or any other geometric shape known to those skilled in the art that would allow the balls to move within the internal region 778. Also, in an alternative embodiment, each of the plurality of balls 730 could be coated with a plastic layer or a rubber compound layer.

The first endcap member 740 is configured to be removably coupled to the first end portion 771 and to cover an opening of the first end portion 771. The first endcap member 740 has a body portion 780, a cap portion 782 coupled to the body portion 780, and a sound reducing member 783 coupled to the body portion 780. The body portion 780 has an external surface 790 defining a plurality of ridges 792. The body portion 780 is configured to be received in the internal region 778 at the first end portion 771. The cap portion 782 is disposed adjacent to an end of the first end portion 771 when the body portion 780 is disposed in the internal region 778. The sound reducing member 783 is configured to contact at least one ball of the plurality of balls 730 to reduce an amount of sound when the at least one ball contacts the first endcap member 740. In one exemplary embodiment, the first endcap member 740 is constructed of plastic, and a maximum diameter of the body portion 780 is greater than a diameter of the internal region 778 prior to the body portion 780 being disposed in the internal region 778 such that the body portion 780 can be press-fit into the first end portion 771. In alternative embodiments, the first endcap member 740 could be constructed of other pliable materials other than plastic, such as a rubber compound, for example. The first endcap member 740 can be decoupled from the second tubular member 722 by applying a longitudinally extending force to the cap portion 782 outwardly from the second tubular member 722. The sound reducing member 783 may be constructed of an elastomeric material or a glue or an adhesive.

The second endcap member 750 is configured to be removably coupled to the second end portion 772 and to cover an opening of the second end portion 772. The second endcap member 750 has a body portion 800, a cap portion 802 coupled to the body portion 800, and a sound reducing member 803 coupled to the body portion 800. The body portion 800 has an external surface 810 defining a plurality of ridges 812. The body portion 800 is configured to be received in the internal region 778 at the second end portion 772. The cap portion 802 is disposed adjacent to an end of the second end portion 772 when the body portion 800 is disposed in the internal region 778. The sound reducing member 803 is configured to contact at least one ball of the plurality of balls 730 to reduce an amount of sound when the at least one ball contacts the second endcap member 750. In one exemplary embodiment, the second endcap member 750 is constructed of plastic, and a maximum diameter of the body portion 800 is greater than a diameter of the internal region 778 prior to the body portion 800 being disposed in the internal region 778 such that the body portion 800 can be press-fit into the second end portion 772. In alternative embodiments, the second endcap member 750 could be constructed of other pliable materials other than plastic, such as a rubber compound, for example. The second endcap member 750 can be decoupled from the second tubular member 722 by applying a longitudinally extending force to the cap portion 802 outwardly from the second tubular member 722. The sound reducing member 803 may be constructed of an elastomeric material or a glue or an adhesive.

Figure 20:
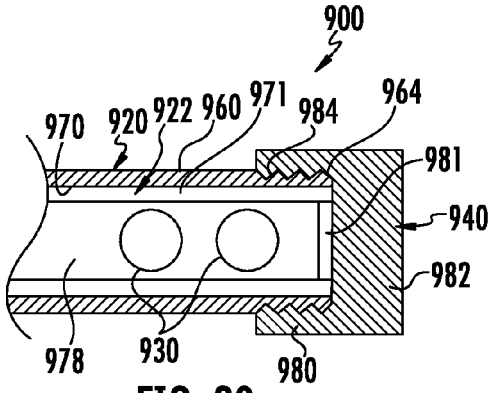
FIG. 20 is a cross-sectional schematic of a portion of another weight-lifting bar in accordance with another exemplary embodiment.
Figure 21:
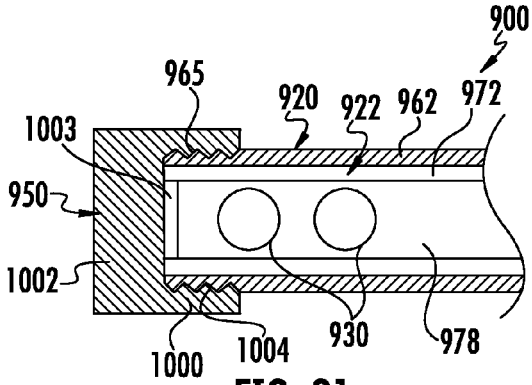
FIG. 21 is a cross-sectional schematic of another portion of the weight-lifting bar of FIG. 20.

Referring to FIGS. 20 and 21, cross-sectional schematics of portions of a weight-lifting bar 900 in accordance with another exemplary embodiment is provided. The weight-lifting bar 900 has a similar structure as the weight-lifting bar 700 except that the weight-lifting bar 900 utilizes first and second endcap members 940, 950 having a different structure than the endcap members 740, 750. Also, weight-lifting bar 900 has the first tubular member 920 with external threads utilized to couple the tubular member 920 to the first and second endcap members 940, 950. The weight-lifting bar 900 includes a first tubular member 920, a second tubular member 922, a plurality of balls 930, the first endcap member 940, the second endcap member 950, and a foam layer (not shown) disposed around an external surface of the tubular member 920.

The first tubular member 920 has a first end portion 960 and a second end portion 962 and a central portion (not shown) disposed between the portions 960, 962. The first tubular member 920 further includes an internal region or space 970 defined therein. The first end portion 960 defines external threads 964, and the second end portion 962 defines external threads 965. In one exemplary embodiment, the first tubular member 920 is constructed of plastic. In an alternative embodiment, the first tubular member 920 is constructed of a metal or a metal-alloy. In one exemplary embodiment, a length of the first tubular member 920 is 48 inches. Of course in alternative embodiments, a length of the first tubular member 920 could be greater than 48 inches or less than 48 inches. Also, in one exemplary embodiment, a diameter of the first tubular member 920 is 0.75 inches. However, an outer diameter of the first tubular member 920 could be greater than 0.25 inches or less than 2 inches for example. A foam layer (not shown) is coupled to an exterior surface of the first tubular member 920, and has a substantially similar structure as the foam layer 52.

The second tubular member 992 has a first end portion 971 and a second end portion 972 with a central portion (not shown) disposed therebetween. The second tubular member 922 further includes an internal region or space 978 defined therein. The second tubular member 922 is disposed within the internal region 970 of the first tubular member 920. In one exemplary embodiment, the second tubular member 922 is constructed of a plastic. In an alternative embodiment, the second tubular member 922 is constructed of an elastomeric material. In one exemplary embodiment, a length of the second tubular member 922 is 48 inches. Of course in alternative embodiments, a length of the second tubular member 922 could be greater than 48 inches or less than 48 inches. Also, in an exemplary embodiment, an outer diameter of the second tubular member 922 is 0.75 inches. However, an outer diameter of the second tubular member 922 could be greater than 0.25 inches or less than 2 inches for example. In an alternative embodiment, a sound reducing layer (not shown) may be disposed between the first and second tubular members 920, 922 to reduce an amount of sound emitted from the weight-lifting bar 900 by the plurality of balls 930 moving therein.

The plurality of balls 930 are disposed in the internal region 978 of the second tubular member 922 and at least partially fill the internal region 978. The plurality of balls 930 have a substantially similar structure as the plurality of balls 730 and can have alternative sizes, quantities, and shapes as discussed above with respect to the balls 730.

The first endcap member 940 is configured to be removably coupled to the first end portion 960 and to cover an opening of the first end portion 960. The first endcap member 940 has a tubular body portion 980, a cap portion 982 coupled to the body portion 980, and a sound reducing member 981 coupled to the cap portion 982. The tubular body portion 980 has internal threads 984 configured to be coupled to the external threads 964 of the first end portion 960. The cap portion 982 is disposed adjacent to an opening of the first end portion 960 when the body portion 980 is threadably coupled to the first end portion 960. The sound reducing member 981 is configured to contact at least one ball of the plurality of balls 930 to reduce an amount of sound when the at least one ball contacts the first endcap member 940. In one exemplary embodiment, the first endcap member 940 is constructed of plastic. In alternative embodiments, the first endcap member 940 could be constructed of materials other than plastic, such as a metal or a metal-alloy for example. The sound reducing member 981 may be constructed of an elastomeric material or a glue or an adhesive.

The second endcap member 950 is configured to be removably coupled to the second end portion 962 and to cover an opening of the second end portion 962. The second endcap member 950 has a tubular body portion 1000, a cap portion 1002 coupled to the body portion 1000, and a sound reducing member 1003 coupled to the cap portion 1002. The tubular body portion 1000 has internal threads 1004 configured to be coupled to the external threads 965 of the second end portion 962. The cap portion 1002 is disposed adjacent to an opening of the second end portion 962 when the tubular body portion 1000 is threadably coupled to the second end portion 962. The sound reducing member 1003 is configured to contact at least one ball of the plurality of balls 930 to reduce an amount of sound when the at least one ball contacts the second endcap member 950. In one exemplary embodiment, the second endcap member 950 is constructed of plastic. In alternative embodiments, the second endcap member 950 could be constructed of materials other than plastic, such as a metal or a metal-alloy for example. The sound reducing member 1003 may be constructed of an elastomeric material or a glue or an adhesive.

Figure 22:
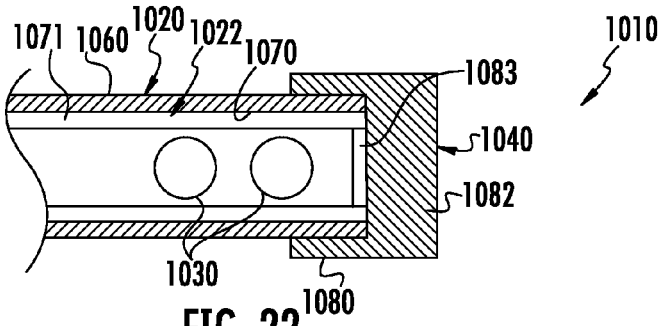
FIG. 22 is a cross-sectional schematic of a portion of another weight-lifting bar in accordance with another exemplary embodiment.
Figure 23:
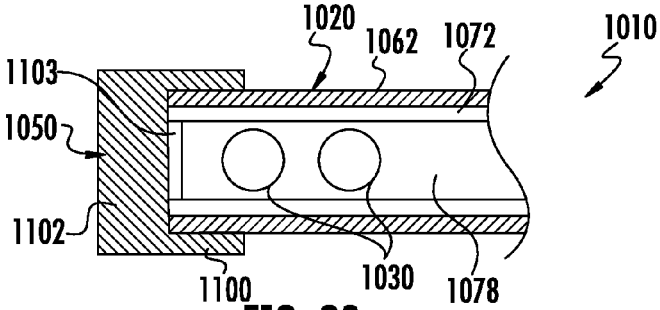
FIG. 23 is a cross-sectional schematic of another portion of the weight-lifting bar of FIG. 22.

Referring to FIGS. 22 and 23, cross-sectional schematics of portions of a weight-lifting bar 1010 in accordance with another exemplary embodiment is provided. The weight-lifting bar 1010 has a similar structure as the weight-lifting bar 900 except that the weight-lifting bar 1010 utilizes first and second endcap members 1040, 1050 having a different structure than the endcap members 940, 950. The weight-lifting bar 1010 includes a first tubular member 1020, a second tubular member 1022, a plurality of balls 1030, the first endcap member 1040, the second endcap member 1050, and a foam layer (not shown) disposed around an external surface of the first tubular member 1020.

The first tubular member 1020 has a first end portion 1060 and a second end portion 1062 and a central portion (not shown) disposed between the portions 1060, 1062. The first tubular member 1020 further includes an internal region or space 1070 defined therein. In one exemplary embodiment, the first tubular member 1020 is constructed of plastic. In an alternative embodiment, the first tubular member 1020 is constructed of a metal or a metal-alloy. In one exemplary embodiment, a length of the first tubular member 1020 is 48 inches. Of course in alternative embodiments, a length of the first tubular member 1020 could be greater than 48 inches or less than 48 inches. Also, in one exemplary embodiment, a diameter of the first tubular member 1020 is 0.75 inches. However, an outer diameter of the first tubular member 1020 could be greater than 0.25 inches or less than 2 inches for example. A foam layer (not shown) is coupled to an exterior surface of the first tubular member 1020, and has a substantially similar structure as the foam layer 52.

The second tubular member 1092 has a first end portion 1071 and a second end portion 1072 with a central portion (not shown) disposed therebetween. The second tubular member 1022 further includes an internal region or space 1078 defined therein. The second tubular member 1022 is disposed within the internal region 1070 of the first tubular member 1020. In one exemplary embodiment, the second tubular member 1022 is constructed of a plastic. In an alternative embodiment, the second tubular member 1022 is constructed of an elastomeric material. In one exemplary embodiment, a length of the second tubular member 1022 is 48 inches. Of course in alternative embodiments, a length of the second tubular member 1022 could be greater than 48 inches or less than 48 inches. Also, in an exemplary embodiment, an outer diameter of the second tubular member 1022 is 0.75 inches. However, an outer diameter of the second tubular member 1022 could be greater than 0.25 inches or less than 2 inches for example. In an alternative embodiment, a sound reducing layer (not shown) may be disposed between the first and second tubular members 1020, 1022 to reduce an amount of sound emitted from the weight-lifting bar 900 by the plurality of balls 1030 moving therein.

The plurality of balls 1030 are disposed in the internal region 1078 of the tubular member 1022 and at least partially fill the internal region 1078. The plurality of balls 1030 have a substantially similar structure as the plurality of balls 930 and can have alternative sizes, quantities, and shapes as discussed above with respect to the balls 930.

The first endcap member 1040 is configured to be coupled to the first end portion 1060 and to cover an opening of the first end portion 1060. The first endcap member 1040 has a tubular body portion 1080, a cap portion 1082 coupled to the body portion 1080, and a sound reducing member 1083 coupled to the cap portion 1082. The tubular body portion 1080 is configured to be coupled to the first end portion 1060 utilizing a glue or an adhesive therebetween. The cap portion 1082 is disposed adjacent to an opening of the first end portion 1060 when the body portion 1080 is coupled to the first end portion 1060. The sound reducing member 1083 is configured to contact at least one ball of the plurality of balls 1030 to reduce an amount of sound when the at least one ball contacts the first endcap member 1040. In one exemplary embodiment, the first endcap member 1040 is constructed of plastic. In alternative embodiments, the first endcap member 1040 could be constructed of materials other than plastic, such as a metal or a metal-alloy for example. The sound reducing member 1083 may be constructed of an elastomeric material or a glue or an adhesive.

The second endcap member 1050 is configured to be coupled to the second end portion 1062 and to cover an opening of the second end portion 1062. The second endcap member 1050 has a tubular body portion 1100, a cap portion 1102 coupled to the body portion 1100, and a sound reducing member 1103 coupled to the cap portion 1102. The tubular body portion 1100 is configured to be coupled to the second end portion 1062 utilizing a glue or an adhesive therebetween. The cap portion 1102 is disposed adjacent to an opening of the second end portion 1062 when the tubular body portion 1100 is coupled to the second end portion 1062. The sound reducing member 1103 is configured to contact at least one ball of the plurality of balls 1030 to reduce an amount of sound when the at least one ball contacts the second endcap member 1050. In one exemplary embodiment, the second endcap member 1050 is constructed of plastic. In alternative embodiments, the second endcap member 1050 could be constructed of materials other than plastic, such as a metal or a metal-alloy for example. The sound reducing member 1103 may be constructed of an elastomeric material or a glue or an adhesive.

The weight-lifting bars 10, 200, 400, 600, 700, 900 and 1010 and associated methods provide a substantial advantage over other weight-lifting bars and methods. In particular, the weight-lifting bars 10, 200, 400, 600, 700, 900 and 1010 and associated methods provide a technical effect of utilizing a plurality of balls within an interior region that can move within the interior region based on the orientation of the weight-lifting bars.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

I claim:

1. A weight-lifting bar, comprising:

a metal tubular member having a first internal region;

a plastic tubular member having a first end portion and a second end portion, the plastic tubular member further having a second internal region, the plastic tubular member being disposed in the first internal region, a length of the metal tubular member being equal to a length of the plastic tubular member;

a first layer coupled to an exterior surface of the metal tubular member;

a plurality of balls disposed in the second internal region of the plastic tubular member that at least partially fills the second internal region;

a first endcap member configured to cover an opening in the first end portion, the first endcap member having a first body portion and a first cap portion, the first body portion of the first endcap member being disposed and press-fit into the first end portion of the plastic tubular member within the second internal region, the first body portion of the first endcap member being constructed of a rubber compound, the first cap portion of the first endcap member contacting an end of the first end portion and a first end of the metal tubular member; and a second endcap member configured to cover an opening in the second end portion.

2. The weight-lifting bar of claim 1, wherein the first body portion of the first endcap member has an external surface defining a plurality of ridges, the plurality of ridges contacting an inner surface of the plastic tubular member.

3. The weight-lifting bar of claim 1, further comprising a sound reducing layer disposed between the metal tubular member and the plastic tubular member, the sound reducing layer being constructed of an elastomeric material.

4. The weight-lifting bar of claim 1, wherein the first layer is a foam layer.

5. The weight-lifting bar of claim 1, wherein the plurality of balls are a plurality of solid metal balls.

6. The weight-lifting bar of claim 1, wherein a weight of the weight-lifting bar is in a range of 2-25 pounds.

7. The weight-lifting bar of claim 1, wherein the second endcap member has a first body portion and a first cap portion, the first body portion of the second endcap member being disposed and press-fit into the second end portion of the plastic tubular member within the second internal region, the first body portion of the second endcap member being constructed of a rubber compound, the first cap portion of the second endcap member contacting an end of the second end portion and a second end of the metal tubular member.

8. The weight-lifting bar of claim 1, wherein a longitudinal length of the first body portion of the first endcap member is greater than a diameter of each ball of the plurality of balls.

9. The weight-lifting bar of claim 8, wherein the first body portion of the first endcap member is configured to substantially fill the second internal region proximate to the first end portion.

10. The weight-lifting bar of claim 8, wherein a maximum diameter of the first body portion of the first endcap member is greater than a diameter of the second internal region prior to the first body portion of the first endcap member being press-fit into the first end portion.

11. A weight-lifting bar, comprising:

a metal tubular member having a first internal region;

a plastic tubular member having a first end portion and a second end portion, the plastic tubular member further having a second internal region, the plastic tubular member being disposed in the first internal region, a length of the plastic tubular member being equal to a length of the metal tubular member;

a first layer coupled to an exterior surface of the metal tubular member;

a plurality of solid metal balls disposed in the second internal region of the plastic tubular member that at least partially fills the second internal region;

a first endcap member configured to cover an opening in the first end portion, the first endcap member having a first body portion and a first cap portion, the first body portion of the first endcap member being disposed and press-fit into the first end portion of the plastic tubular member within the second internal region, the first body portion of the first endcap member being constructed of a rubber compound, the first body portion of the first endcap member being configured to substantially fill the second internal region proximate to the first end portion, the first cap portion of the first endcap member contacting an end of the first end portion and a first end of the metal tubular member; and a second endcap member configured to cover an opening in the second end portion.

12. The weight-lifting bar of claim 11, wherein the first endcap member has a first elastomeric sound reducing member disposed in the second internal region proximate to a first end of the plastic tubular member, the first elastomeric sound reducing member configured to contact at least one ball of the plurality of solid metal balls.

13. The weight-lifting bar of claim 12, wherein the second endcap member has a second elastomeric sound reducing member disposed in the second internal region, the second elastomeric sound reducing member configured to contact at least one ball of the plurality of solid metal balls.

14. The weight-lifting bar of claim 11, wherein a weight of the weight-lifting bar is in a range of 2-25 pounds.

15. The weight-lifting bar of claim 11, further comprising an elastomeric sound reducing layer disposed between the metal tubular member and the plastic tubular member.

* * * * *